US007252535B2

(12) United States Patent
Kumakura

(10) Patent No.: US 7,252,535 B2
(45) Date of Patent: Aug. 7, 2007

(54) FLAT CIRCUIT BODY WITH TERMINALS, METHOD OF MANUFACTURING THE SAME, DIE SYSTEM FOR MANUFACTURING THE SAME AND MANUFACTURING APPARATUS FOR THE SAME

(75) Inventor: Hideto Kumakura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/353,110

(22) Filed: Feb. 14, 2006

(65) Prior Publication Data

US 2006/0228930 A1 Oct. 12, 2006

(30) Foreign Application Priority Data

Apr. 7, 2005 (JP) ..... 2005-110581

(51) Int. Cl.
*H01R 4/24* (2006.01)

(52) U.S. Cl. ..... 439/422

(58) Field of Classification Search ..... 439/421, 439/422, 877, 310; 174/84 C; 29/861, 863
See application file for complete search history.

(56) References Cited

U.S. PATENT DOCUMENTS 3,697,925 A * 10/1972 Henschen ..... 439/494
3,924,917 A * 12/1975 Munshower ..... 439/422
6,626,695 B2 * 9/2003 Enomoto et al. ..... 439/422
6,652,310 B2 * 11/2003 Onuma ..... 439/422
6,869,305 B2 * 3/2005 Enomoto et al. ..... 439/422

FOREIGN PATENT DOCUMENTS

JP 2002-246091 A 8/2002

* cited by examiner

*Primary Examiner*—Khiem Nguyen
(74) *Attorney, Agent, or Firm*—Sughrue Mion, PLLC

(57) ABSTRACT

Providing a method of manufacturing a flat circuit body with terminals with small number of steps of process, a terminal pressure welding apparatus includes a pair of dies having respectively a recess, in which claws of a piercing terminal penetrating through a conductive area of a flat circuit body. The dies are slid in a direction intersecting to a direction of the claw piercing in the flat circuit body by cylinders as a slide unit. Thereby, the claws received in the recess abuts seriously and gradually on a second curved surface and a first curved surface provided in the recess so as to be bent smoothly and fixed on the flat circuit body.

10 Claims, 7 Drawing Sheets

FLAT CIRCUIT BODY WITH TERMINALS, METHOD OF MANUFACTURING THE SAME, DIE SYSTEM FOR MANUFACTURING THE SAME AND MANUFACTURING APPARATUS FOR THE SAME

The priority application Number Japan Patent Application 2005-110581 upon which this patent application is based is hereby incorporated by reference.

BACKGROUND OF THE INVENTION

1. Field of the Invention

This invention relates to a flat circuit body with terminals, which is made by connecting terminals, such as a piercing terminal, with a conductive area of a flexible flat circuit body, such as an FPC (Flexible Printed Circuit) and an FFC (Flexible Flat Cable).

2. Description of the Related Art

Various electronic apparatuses are installed in a car as a vehicle. In the car, a wiring harness is wired for transmitting electric power and control signals. The wiring harness includes a plurality of electric wires and a plurality of connectors. The electric wire has a conductive core wire and an insulation cover for covering the core wire, as a covered wire.

The connector has a pair of insulation connector housings to be fit to each other and conductive terminals received in respective housings. The terminal includes a wire connecting portion at one end thereof to be joined with an end of the electric wire for connecting electrically with the core wire and an electric contact portion at the other end thereof to be in contact with a mating terminal. The wiring harness transmits the control signals to the electronic apparatuses through connecting the connectors to each other.

At present time, the wiring harness is having more amount of wires according to increase of electronic apparatuses installed in the car. Therefore, flat circuit body, such as the FFC and the FPC, which is lighter and thinner than a usual used round wire and can be wired compactly in high density, is used in many cases as the electric wire.

For joining the terminal with the flat circuit body, a terminal pressure welding machine 204 shown in FIG. 9 is usually used. In the terminal pressure welding machine 204, by piling a terminal 102, in which a plurality of claws 124 projects in alternate positions thereof, on a flat circuit body 103 on a crimper 245, pressing the terminal 102 by an anvil 247 so as to make each claw 124 pierce in a conductive area 131 of the flat circuit body 103, and bending the claws piercing the conductive area 131 and a cover 132 of the flat circuit body 103 to face inwardly to each other, the terminal 102 is mounted on the flat circuit body 103. The flat circuit body 103, on which the terminal 102 is mounted as mentioned above (call the flat circuit body with terminals hereafter), is assembled as the aforesaid wiring harness by that the terminals are received in the connector housing.

However, the usual terminal pressure welding machine 204 shown in FIG. 9 deforms the flat circuit body 103 bent toward the crimper 204 when each claw 124 pierces in the flat circuit body 103, so that it is difficult to make securely the claw pierce in the conductive area 131 of the flat circuit body 103. A terminal pressure welding machine 104 (refer Patent Document 1), which intends to make the claws 124 pierce securely in the conductive area 131 of the flat circuit body 103 by separating a process of making the claw 124 pierce in the flat circuit body 103 and a process of bending the claw as shown in FIG. 10, is provided. Reference Patent 1 is Japan Patent Application Laid Open No. 2002-246091.

The terminal pressure welding machine 104 shown in FIG. 10 is provided with a bottom die 145, in which a piercing die 145A having a pair of grooves 152 to receive the claws 124 of the terminal 102 piecing in the flat circuit body 103 shown in FIG. 9 and a crimping die 145B having a recess 153 for bending the claws 124 piercing in the flat circuit body 103.

In a process of making the claw 124 pierce in the flat circuit body 103 in the aforesaid terminal pressure welding machine 104, by setting the piercing die 145A in a position to face an anvil 147, piling the flat circuit body 103 and the terminal 102 on the piercing die 145A, and pressing the terminal 102 by the anvil 147 to make the claw 124 piece in the conductive area of the flat circuit body 103, the claw 124 piecing the flat circuit body 103 is received in the groove 152 of the piecing die 145A. A surface 155, on which the flat circuit body 103 is piled between the pair of grooves of the piercing die 145A, supports the flat circuit body 103. Thereby, the flat circuit body 103 is prevented from deformation to be bent in the grooves 152. Therefore, the claw 124 can pierce securely in the conductive area 131 of the flat circuit body 103.

In a process of bending the claw 124 piercing in the flat circuit body 103 in the terminal pressure welding machine 104, by moving the bottom die 145 down in a direction of an arrow Y and moving the bottom die 145 horizontally in a direction of an arrow X for positioning the crimping die 145B to face a front end of the claw 124, the crimping die 145B is set in a position to face the claw 124 by moving the bottom die 145 upwardly in a direction opposite to the direction of arrow Y. Thereafter, by pressing the terminal 102 by the anvil 147, the claw 124 is bent along a curved surface of the recess 153 of the crimping die 145B, and the terminal 102 is mounted on the flat circuit body 103.

SUMMARY OF THE INVENTION

Objects to be Solved

The terminal pressure welding machine 104 shown in FIG. 10 can prevent the flat circuit body 103 from deformation. For the purpose, changing the piecing die 145A and the crimping die 145B is required, so that number of processes increase.

The terminal pressure welding machine 204 shown in FIG. 9 or the terminal pressure welding machine 104 shown in FIG. 10 bends each claw 124 to add a load to squash the claw 124 on the claw 124 by making the anvil 247 and the crimper 245 approach to each other or making the anvil 147 and the crimping die 145B approach to each other. Therefore, the load is concentrated on the front end of the claw 124 and the front end of the claw 124 is shaved, so that durability of the claw 124 is reduced.

To overcome the above problems, objects of this invention are to provide a flat circuit body with terminals, which can be manufactured by small number of steps of working processes, a method of manufacturing the same, a die system for manufacturing the same, and a manufacturing apparatus for the same.

How to Attain the Object of the Present Invention

In order to attain the objects of the present invention, a method of manufacturing the flat circuit body with terminals according to an aspect of the present invention is the method of manufacturing the flat circuit body with terminals, which includes the flat circuit body having a flat conductive area and a conductive metal terminal having a claw to pierce in the flat conductive area of the flat circuit body and to be bent, and includes the steps of making the claw pierce in the conductive area of the flat circuit body, placing the claw piecing in the conductive area into a recess of a die, which can move freely along a direction intersecting to a direction of making the claw pierce in the conductive area, and sliding the die in the direction intersecting to the direction of making the claw pierce in the conductive area for bending the claw.

A die system for manufacturing a flat circuit body with terminals according to another aspect of the present invention is a die system for manufacturing the flat circuit body with terminals, which includes the flat circuit body having a flat conductive area and a conductive metal terminal having a claw to pierce in the flat conductive area of the flat circuit body and to be bent, and includes a pair of dies having respectively a recess denting from a surface, on which the flat circuit body is piled, for receiving the claw piercing in the flat conductive area of the flat circuit body within the recess, and the pair of dies can move freely along a direction intersecting to a direction of making the claw pierce in the conductive area.

The die system for manufacturing the flat circuit body with terminals according to the present invention is characterised in the die system for manufacturing the flat circuit body with terminals mentioned above by that the pair of dies include support blocks having the surface, and the support blocks are positioned between respective recesses when the claws piercing in the conductive area of the flat circuit body penetrate into the recesses.

The die system for manufacturing the flat circuit body with terminals according to the present invention is characterised in the die system for manufacturing the flat circuit body with terminals mentioned above by that a first curved surface is provided on an inner surface of the recess so as to be continuous to the surface and be concave from said inner surface, on which the claw abuts when the claw is bent.

The die system for manufacturing the flat circuit body with terminals according to the present invention is characterised in the die system for manufacturing the flat circuit body with terminals mentioned above by that a second curved surface is provided on said inner surface of the recess to be continuous to the first curved surface and be convex from the inner surface of the recess.

A manufacturing apparatus for a flat circuit body with terminals according to another aspect of the present invention is the manufacturing apparatus for the flat circuit body with terminals, which includes the flat circuit body having a flat conductive area and conductive metal terminals having a claw to pierce in the flat conductive area of the flat circuit body and to be bent, and includes the die system mentioned above, a press unit moving freely close to and apart from the die system for pressing the claw to pierce in the conductive area and making the claw piercing in the conductive area penetrate into the recess by moving close to the die system, and a slide unit for bending the claw penetrating in the recess by sliding the die in the direction intersecting to the direction of making the claw pierce in the conductive area.

A flat circuit body with terminals according to another aspect of the present invention includes a flat circuit body having a flat conductive area, and a conductive metal terminal having a claw to pierce in the flat conductive area of the flat circuit body and to be bent, and the claw piercing in the conductive area of the flat circuit body, which penetrates into a recess of a die freely movable in a direction intersecting to a direction of making the claw pierce in the conductive area, is bent by sliding the die in the direction intersecting to the direction of making the claw pierce in the conductive area.

According to the above method of manufacturing the flat circuit body with terminals, by placing the claw piecing in the conductive area into a recess of a die, and sliding the die in the direction intersecting to the direction of making the claw pierce in the conductive area, the claw placed in the recess can be bent. Thereby, processes of claw piercing and bending the claw can be performed continuously in one die. Therefore, the flat circuit body with terminals can be manufactured by small number of steps of working processes.

The die system of manufacturing the flat circuit body with terminals as mentioned above includes the pair of dies having respectively a recess denting from a surface, on which the flat circuit body is piled, for receiving the claw piercing in the flat conductive area of the flat circuit body within the recess, and the pair of dies can move freely along a direction intersecting to a direction of making the claw pierce in the conductive area, so that the claw placed in the recess can be bent. Thereby, processes of claw piercing and bending the claw can be performed continuously in one die. Therefore, the flat circuit body with terminals can be manufactured by small number of steps of working processes.

According to the die system of manufacturing the flat circuit body with terminals as mentioned above, when the claw piercing in the conductive area of the flat circuit body penetrates into the recess, the support blocks having the surface, which are positioned between respective recesses, are positioned, so that the flat circuit body is supported by the support blocks having the surface. Thereby, the flat circuit body can be prevented from deformation to be bent into the recess. Thereby, the flat circuit body with terminals can be manufactured by small number of steps of working processes, and the claw can pierce securely in the flat circuit body. Therefore, reliability of connecting the claw and the conductive area of the flat circuit body can be improved.

According to the die system of manufacturing the flat circuit body with terminals as mentioned above, when bending the claw, the first curved surface abuts on the claw placed in the recess and bends the claw smoothly. Therefore, the flat circuit body with terminals can be manufactured by small number of steps of working processes, and the claw can be bent without concentration of load on a part of the claw. Therefore, wearing of the die system can be reduced, so that a useful life of the die system can be extended.

According to the die system of manufacturing the flat circuit body with terminals as mentioned above, when bending the claw, the first curved surface and the second curved surface continuous to the first curved surface abut on the claw placed in the recess and bends the claw more smoothly. Therefore, the flat circuit body with terminals can be manufactured by small number of steps of working processes, and the claw can be bent without concentration of load on a part of the claw. Therefore, wearing of the die system can be reduced, so that a useful life of the die system can be extended.

The manufacturing apparatus for a flat circuit body with terminals according to the present invention includes the die system mentioned above. Therefore, the flat circuit body with terminals can be manufactured by small number of steps of working processes.

According to the flat circuit body with terminals, the claw piercing in the conductive area of the flat circuit body penetrates into a recess of a die freely movable in a direction intersecting to a direction of making the claw pierce in the conductive area, can be bent by sliding the die in the direction intersecting to the direction of making the claw pierce in the conductive area. Therefore, the flat circuit body with terminals can be manufactured by small number of steps of working processes.

The above and other objects and features of this invention will become more apparent from the following description taken in conjunction with the accompanying drawings.

DESCRIPTION OF THE PREFERRED EMBODIMENT

A flat circuit body with terminals, a method of manufacturing the same, a die system for manufacturing the same and a manufacturing apparatus for the same of one embodiment according to the present invention will be described with reference to FIGS. 1-8.

The flat circuit body in the present invention is defined as a flat slip shape circuit, in which a flat conductive area is covered with an insulator, such as an FPC (Flexible Printed Circuit) and an FFC (Flexible Flat Cable). The flat circuit body with terminals is defined as a the flat circuit body, in the conductive area of which terminals, such as a piercing terminal having a plurality of claws to pierce the conductive area and to be bent for fitting, are connected electrically.

Figure 1:
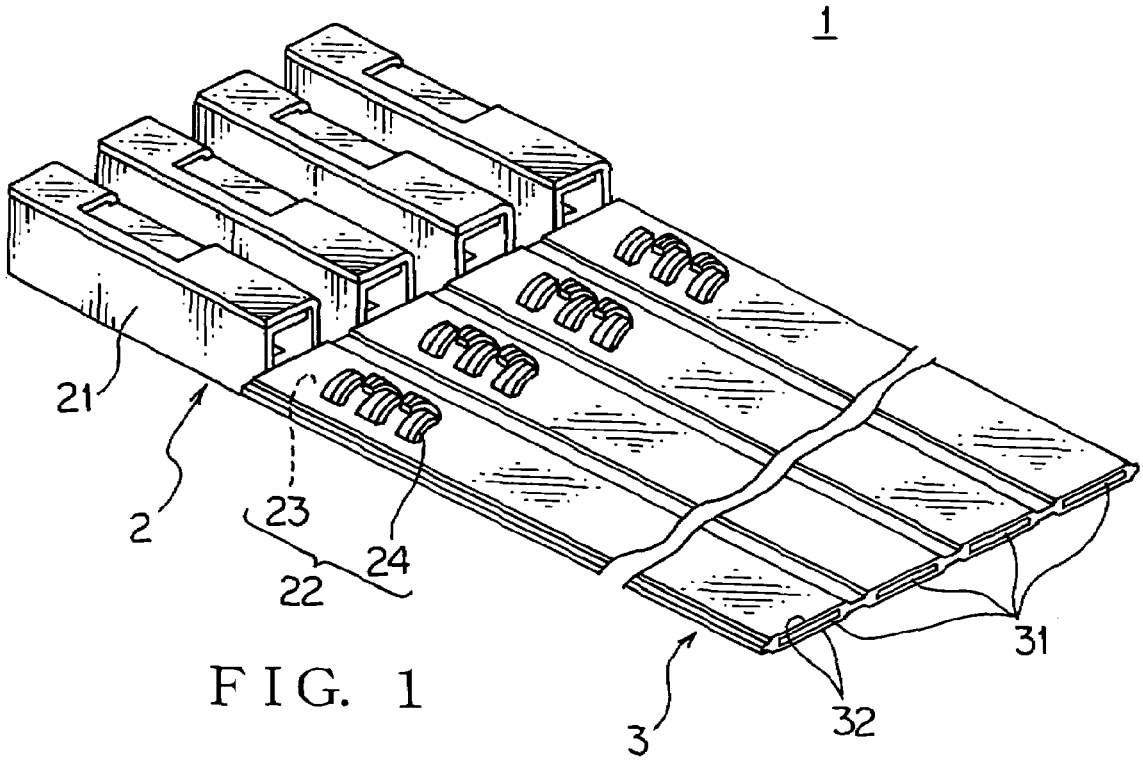
FIG. 1 is a perspective view of a flat circuit body with terminals of an embodiment according to the present invention.

The flat circuit body with terminals 1 has an FFC 3 as a flat circuit body and piercing terminals 2 as terminals. As shown in FIG. 1, the piercing terminals 2 are connected electrically with ends of the FFC 3. The FFC 3 is a tape wire, in which flat conductive areas 31 are provided in parallel and the both surfaces of the conductive areas 31 are covered with an insulator 32 like a polyester tape.

The piercing terminal 2 is made of conductive metal sheet, and formed with an electric contact 21 to be connected with a mating terminal, and an electric connecting portion 22 to be connected with the FFC 3. The electric connecting portion 22 has a bottom wall 23 and a plurality of claws 24 standing from both ends of the bottom wall 23. The plurality of claws 24 is provided along lengthwise of the piercing terminal 2. Respective claws facing to each other are arranged alternately. The claw 24 pierces in the conductive area 31 of the FFC 3 and is in contact with the conductive area 31 so as to be connected electrically with the conductive area 31. Front ends of the piercing plurality of claws 24 are bent inwardly to each other so as to clamp the FFC 3.

Figure 2:
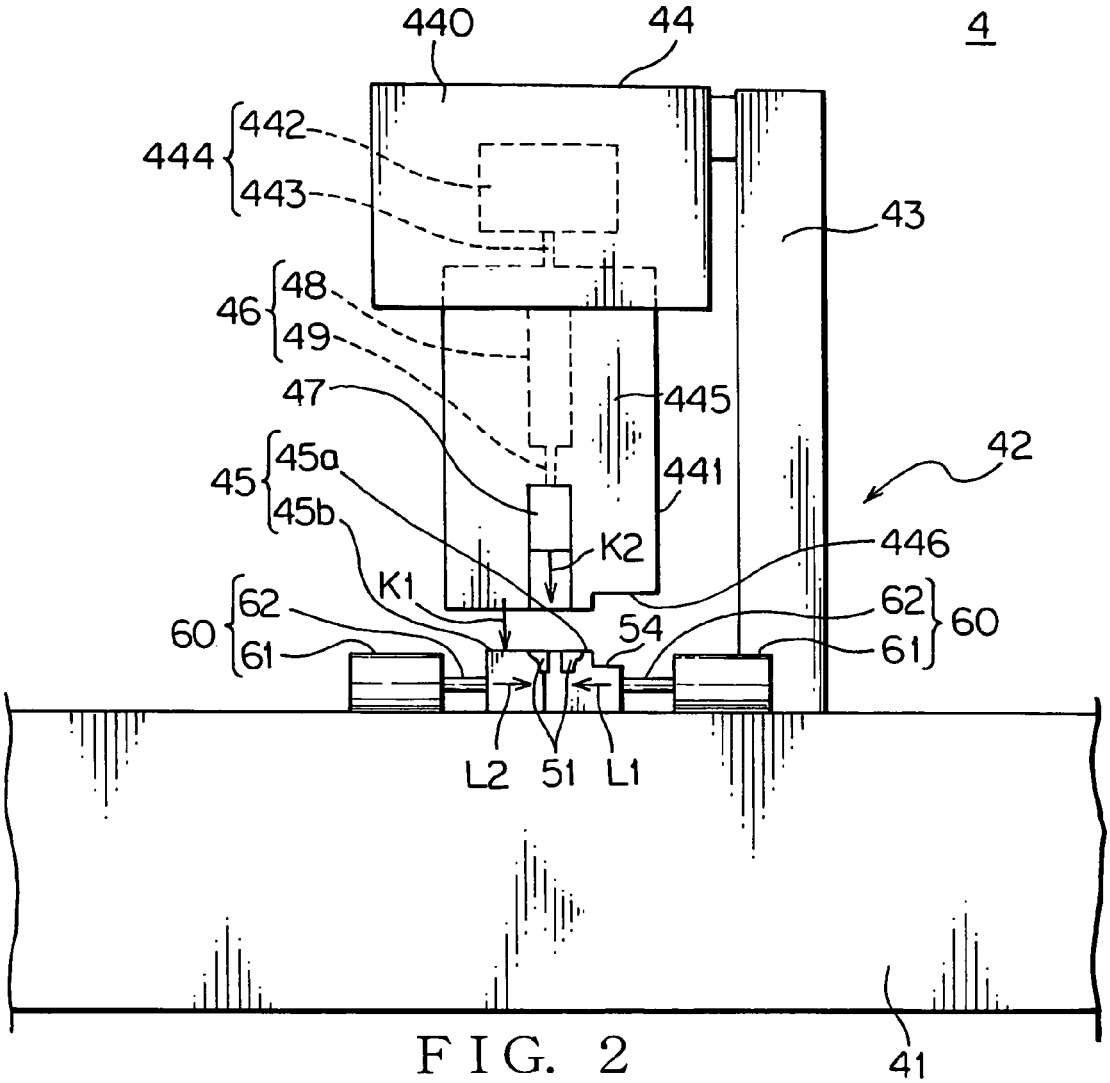
FIG. 2 is a side view of a terminal pressure welding apparatus for manufacturing the flat circuit body with terminals shown in FIG. 1.

The flat circuit body with terminals 1 mentioned above is manufactured by a terminal pressure welding machine 4 shown as follows. The terminal pressure welding machine 4, as a manufacturing apparatus for the flat circuit body with terminals 1, includes a base 41 provided on a floor at a factory, a pressure welding unit 42 provided on the base 41, a wire transmitting unit (not shown) and a terminal supply unit (not shown), as shown in FIG. 2. The wire transmitting unit transmits the FFC 3 cut in a required length to the pressure welding unit 42. The terminal supply unit supplies the piercing terminals 2 to the pressure welding unit 42.

The pressure welding unit 42 presses the FFC 3 and the piercing terminals 2 those are transmitted to connected them to each other. The pressure welding unit 42 includes an arm 43 standing from the base 41, a main body 44 connected with the arm 43, a die system 45 mounted on the base 41 corresponding to the main body 44, and cylinders 60, 60 as later-described slide units for supporting later-described dies 45*a*, 45*b* of the die system 45 moveably in a horizontal direction, as shown in FIG. 2.

The main body 44 includes a mount plate 440 connected with the arm 43, a cylinder 444 mounted on the mount plate 440, and an applicator 441 supported moveably up/down by the cylinder 444. The cylinder 444 has a cylinder body 442 and a rod 443 connecting the cylinder body 442 and a later described movement 445 of the applicator 441. The rod 443 telescopes against the cylinder body 442, so that the movement 445 of the applicator 441 is supported moveably up/down.

The applicator 441 has the movement 445 connected with the rod 443, and the movement 445 is supported moveably up/down by the cylinder 444, so that the movement 445 moves close-to/apart-from the die system 45. The movement 445 moves down in a direction to be close to the die system 45 (shown by an arrow K1 in FIG. 2) by the expanding cylinder 444. A surface of the movement 445 corresponding to the die system 45 presses the FFC 3 and the piercing terminal 2 piled on the die system 45 so as to hold the FFC 3 and the piercing terminal 2.

A relief space 446 is formed on a surface of the movement 445 corresponding to the die system 45. The relief space 446 receives the piercing terminals 2 mounted previously when the piercing terminals 2 are mounted one-by-one in order along widthwise of the FFC 3.

The applicator 441 further includes a cylinder 46 mounted in the movement 445 and a press block 47 supported moveably up/down by the cylinder 46. The cylinder 46 includes a cylinder body 48 and a rod 49 connecting the cylinder body 48 and the press block 47. The rod 49 telescopes against the cylinder body 48, so that the press block 47 is supported moveably up/down.

The press block 47 connected with the rod 49 is supported moveably up/down by the cylinder 48, so as to move close-to/apart-from the die system 45. The press block 47 moves down in a direction to be close to the die system 45 (shown by an arrow K2 in FIG. 2) by the expanding cylinder 48, and presses a bottom wall 23 of the piercing terminal 2 piled on the die system 45 so as to make the claws 24 of the piercing terminal 2 pierce in the conductive area 31 of the FFC 3.

The die system 45 has a pair of dies 45*a*, 45*b* provided corresponding to the movement 445 as shown in FIGS. 2, 5-8. The pair of dies 45*a*, 45*b* is arranged along widthwise (direction of arrows L1, L2 in FIG. 2) of the movement 445. The pair of dies 45*a*, 45*b* is mounted on the base 41, slidably along a direction perpendicular to an up/down direction (direction of the arrow K2 in FIG. 2) of the press block 47 (direction of the claw 24 piercing in the conductive area 31).

The pair of dies 45*a*, 45*b* faces to the movement 445. Each surface 55 (call an abutting surface 55 hereafter) of the pair of dies 45*a*, 45*b*, which abut on the FFC 3, is formed to be flat and be in the same plane. The FFC 3 is piled on the abutting surfaces 55 to align the direction of widthwise thereof in a direction of arranging the pair of dies 45*a*, 45*b* (direction of arrows L1, L2 in FIG. 2).

The pair of dies 45*a*, 45*b* has recesses 51 denting from the abutting surfaces 55, surfaces 56 facing to each other, slits 50A, 50B, 50C denting from the abutting surfaces 55 and a relief space 54 denting from the abutting surface 55.

The pair of dies 45*a*, 45*b* has bottom surfaces 58, opposite to the abutting surfaces 55, to mount on the base 41 and outer surfaces 57 opposite to the surfaces 56, i.e. at a side apart from each mating die 45*a* or 45*b*.

Figure 4:
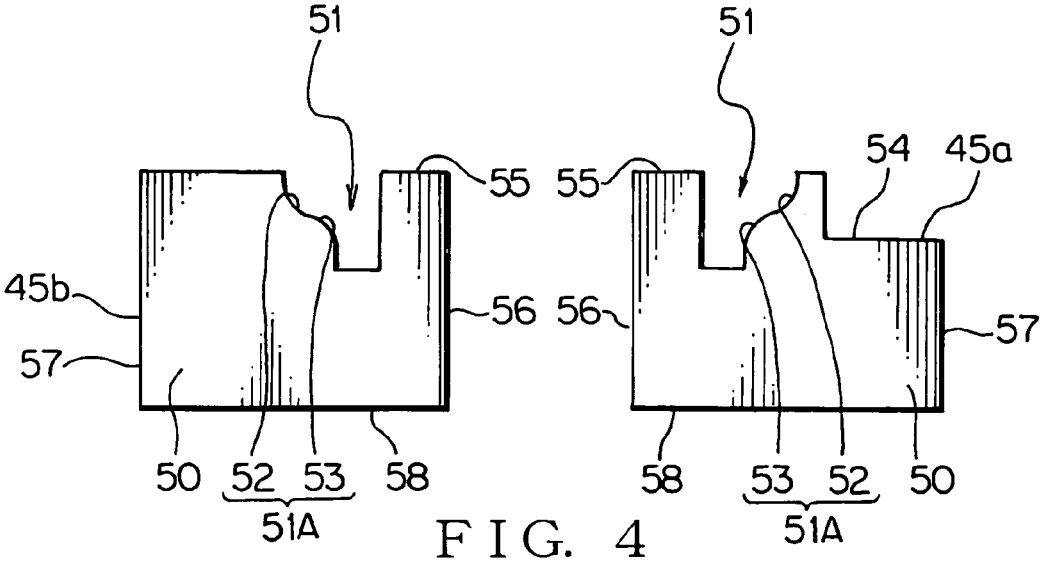
FIG. 4 is an exploded view of the die system shown in FIG. 3.

Each one of the recesses 51 is provided respectively for the pair of dies 45*a*, 45*b* as shown in FIG. 4. The claws 24 piercing in the conductive area of the FFC 3 penetrate into the recess 51. An inner surface 51A of the recess 51 close to the outer surface 57, i.e. the inner surface 51A to abut on the claw when the claw is bent, is provided with a first curved surface 52 continuous to the abutting surface 55 and concave from the inner surface 51A and a second curved surface 53 continuous to the first curved surface 52 and convex from the inner surface 51A.

When the pair of dies 45*a*, 45*b* slide to be close to each other by later-described cylinders 60, 60 as a slide unit, the curved surfaces 52, 53 abut on the claws 24 penetrating in the recess 51 and bend the claws 24 smoothly along the shape of the curved surfaces 52, 53. The recess 51 in the die 45*a* and the recess 51 in the die 45*b* are formed mirror-symmetrically to each other.

Figure 3:
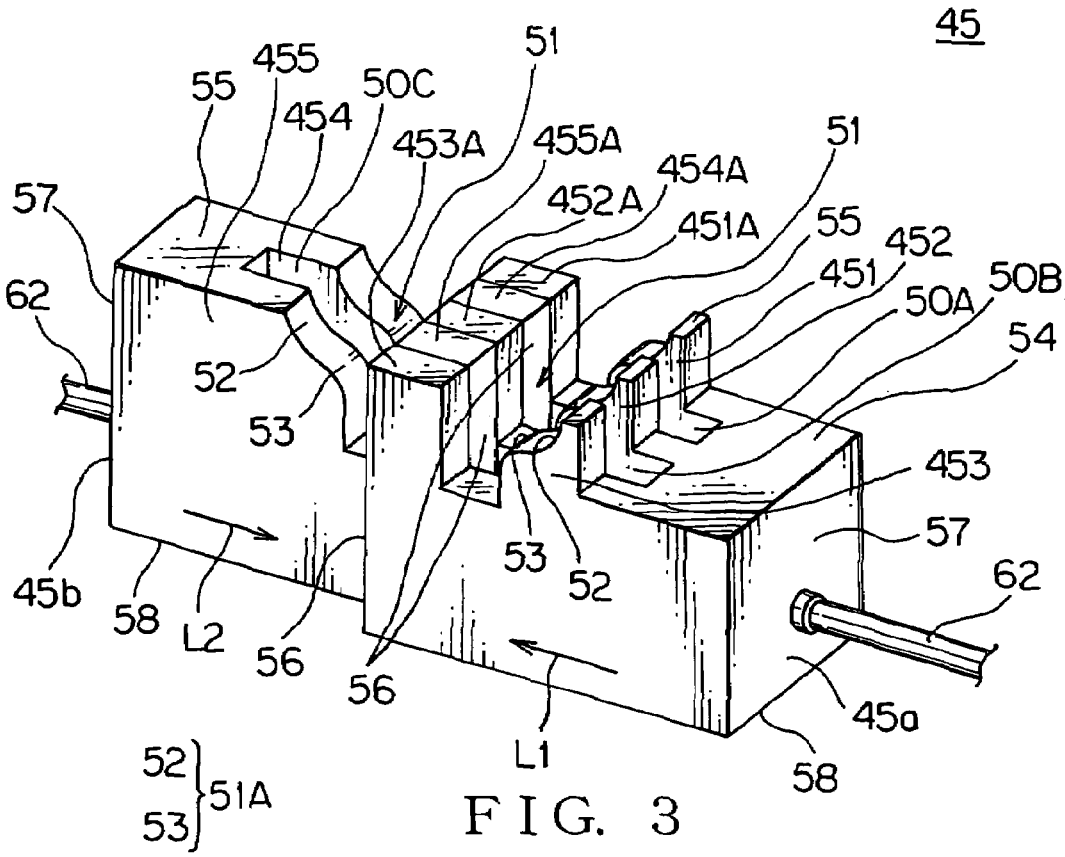
FIG. 3 is a perspective view of a die system mounted in the terminal pressure welding apparatus shown in FIG. 2.

The slits 50A, 50B extend from the surface 56 of the surface 56 of the die 45*a* toward the outer surface 57 so as to be formed longer than the recess 51 to be closer to the outer surface 57 than the recess 51, as shown in FIG. 3. The slits 50A, 50B continue from the abutting surface 55 to the bottom surface 58 so as to open three surfaces, that is, the abutting surface 55, the surface 56 and the bottom surface 58. The slits 50A, 50B are arranged with an interval to each other along lengthwise of the FFC 3 plied on the abutting surface 55. The slits 50A, 50B form plate-like thin walls 451, 452, 453 provided in order, along lengthwise of the FFC 3 plied on the abutting surface 55.

The slit 50C extends from the surface 56 of the surface 56 of the die 45*b* toward the outer surface 57 so as to be formed longer than the recess 51 to be closer to the outer surface 57 than the recess 51, as shown in FIG. 3. The slit 50C continues from the abutting surface 55 to the bottom surface 58 so as to open three surfaces, that is, the abutting surface 55, the surface 56 and the bottom surface 58. The slit 50C forms plate-like thin walls 454, 455 provided in order, along lengthwise of the FFC 3 plied on the abutting surface 55.

The slits 50A, 50B, 50C are arranged alternately along lengthwise of the FFC 3 piled on the abutting surface 55 of the pair of dies 45*a*, 45*b*. The thin wall 452 at a center of the thin walls 451, 452, 453 of the die 45*a* is formed corresponding to the slit 50C of the die 45*b*. The thin walls 454, 455 of the die 45*b* are formed corresponding to the slits 50A, 50B of the die 45*a*.

In the pair of dies 45*a*, 45*b* having such slits 50A, 50B, 50C, the thin walls 454, 455 of the die 45*b* go into the slits 50A, 50B, and thin wall 452 at a center of the thin walls 451, 452, 453 of the mating die 45*a* is formed corresponding to the slit 50C of the die 45*b*. The thin wall 452 at a center of the thin walls 451, 452, 453 of the die 45*a* goes into the slit 50C of the mating die 45*b*. In this condition, the pair of dies 45*a*, 45*b* is mounted slidably on the base 41. The thin walls 454, 455, 452 slide in the slits 50A, 50B, 50C, so that the pair of dies 45*a*, 45*b* slides in a direction intersecting to the direction of the claw 24 piercing in the conductive area 31 of the FFC 3.

The relief space 54 is formed by denting from the abutting surface 55, and opens the outer surface 57. The relief space 54 is provided corresponding to the relief space 446 formed at the movement 445. As same as the aforesaid relief space 446, the relief space 54 receives the piercing terminals 2 mounted previously when the piercing terminals 2 are mounted one-by-one in order along widthwise of the FFC 3.

The pair of dies 45*a*, 45*b* is connected at the outer surface 57 of each die respectively with the cylinders 60, 60 as the slide unit. The cylinder 60 includes a cylinder body 61 and a rod 62 connecting each die 45*a*, 45*b* and the outer surface 57. The rod 62 telescopes against the cylinder body 61, so that each die 45*a*, 45*b* is supported moveably in a horizontal direction, that is in the direction intersecting to the direction of the claw 24 piercing in the FFC 3 (direction of arrows L1, L2 shown in FIG. 2).

In the pair of the dies 45*a*, 45*b* supported moveably by the cylinders 60, 60, when the cylinders 60, 60 are contracted, support blocks 451A, 452A, 453A, 454A, 455A near to the surfaces 56 from the recesses 51 of the thin walls 451, 452, 453, 454, 455 are positioned respectively at the surfaces 56 from the recesses 51 of the mating dies 45*a*, 45*b* so as to be aligned in one line in order along lengthwise of the FFC 3 piled on the abutting surfaces 55. In other word, the support blocks 451A, 452A, 453A, 454A, 4555*a* having abutting surfaces 55 are arranged between the recesses 51 of respective dies 45*a*, 45*b*. When the cylinders 60, 60 are expanded, support blocks 451A, 452A, 453A, 454A, 455A are positioned respectively near to the outer surfaces 57 from the recesses 51 of mating dies 45*a*, 45*b*.

The cylinders 60, 60 telescope as mentioned above, so that the pair of dies 45*a*, 45*b* slide in the direction intersecting to the direction of the claw 24 piercing in the conductive area 31 of the FFC 3. When the cylinders 60, 60 is contracted, that is the support blocks 451A, 452A, 453A, 454A, 455A are positioned between the recesses 51 of respective mating dies 45*a*, 45*b*, the claws 24 pierce in FFC 3, so that the abutting surfaces 55 of the support blocks 451A, 452A, 453A, 454A, 455A prevent deformation of the FFC 3.

Figure 5:
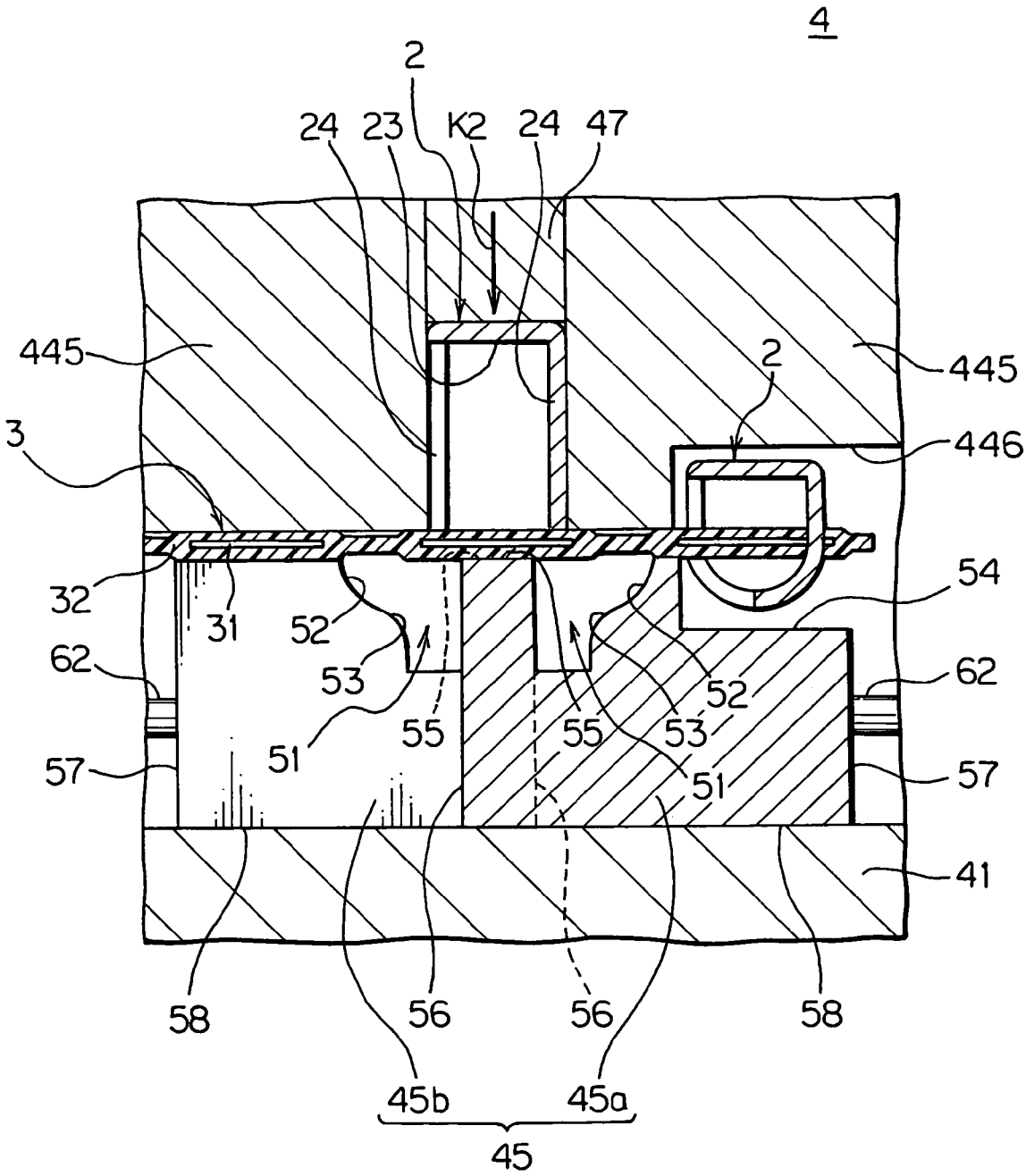
FIG. 5 is a cross-sectional view of the flat circuit body and the terminal positioned in the terminal pressure welding apparatus shown in FIG. 2.

When, by using the above terminal pressure welding apparatus 4, the flat circuit body with terminals 1 is manufactured, all cylinders 444, 46, 60 are firstly contracted. As shown in FIG. 5, the piercing terminals 2 supplied by the terminal supply unit (not shown) are piled on the FFC 3 transmitted on the abutting surfaces 55 of the pair of dies 45*a*, 45*b* by the wire transmitting unit (not shown) to make the front ends of the claws 24 face to the FFC 3.

By extending the cylinder 444, the movement 445 is moved down toward the pair of dies 45*a*, 45*b* so as to clamp the piercing terminal 2 and the FFC 3 between the movement 445 and the pair of dies 45*a*, 45*b*, and fix them.

Figure 6:
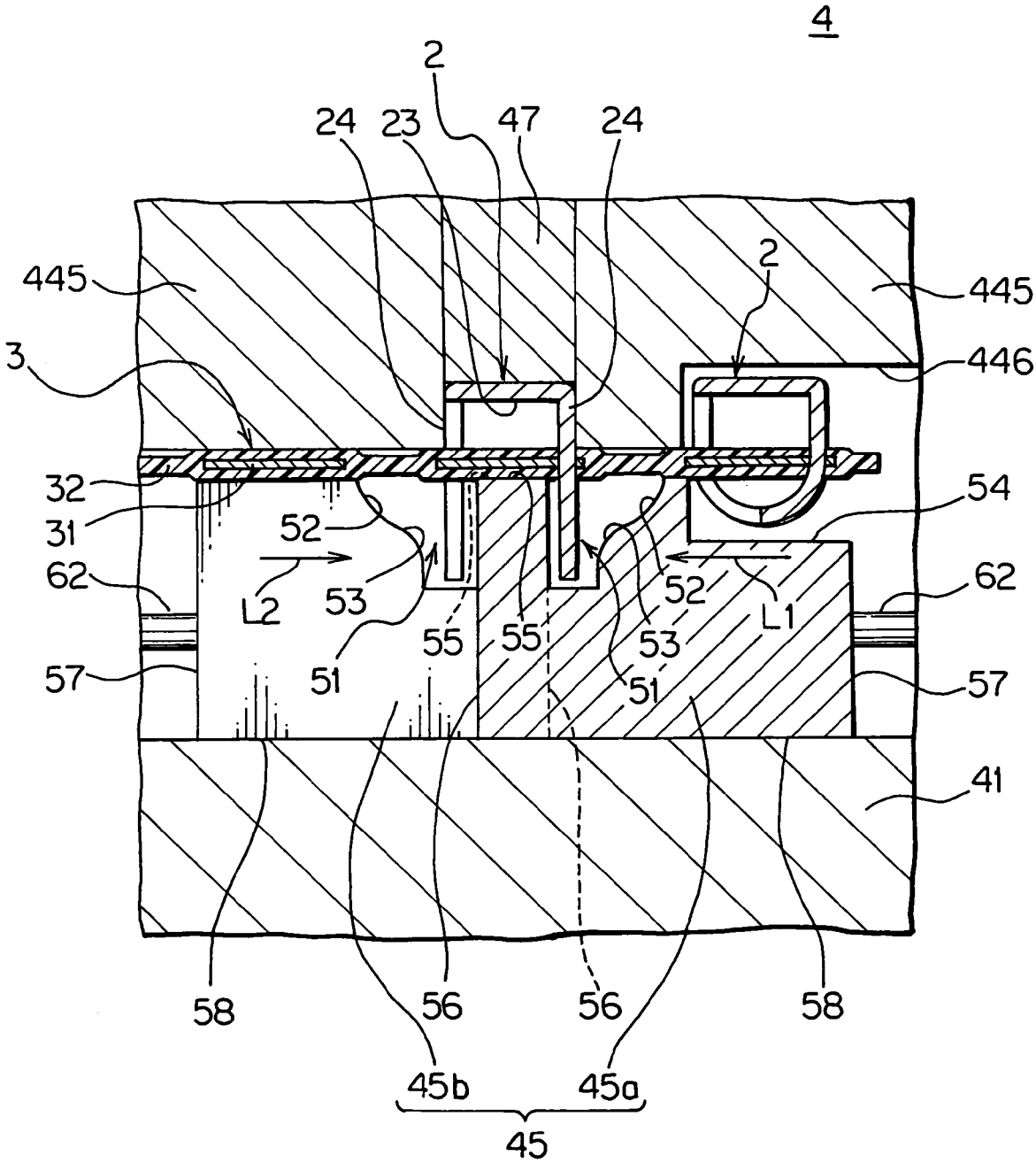
FIG. 6 is a cross-sectional view of the terminal penetrating into the flat circuit body shown in FIG. 5.

By extending the cylinder 46 as shown in FIG. 6, the press block 47 is moved down toward the recesses 51 to press the piercing terminal 2. The plurality of claws 24 of the pressed piercing terminal 2 pierces through the insulator 32 and the conductive area 31 of the FFC 3 and penetrates into the recesses 51. At the time, the FFC 3 pressed toward the recesses 51 by the claws 24 piercing is supported by the abutting surfaces 55 of the support blocks 451A, 452A, 453A, 454A, 455A positioned between the recesses 51 of respective dies 45*a*, 45*b*, and is prevented from deforming toward the recesses 51.

Figure 7:
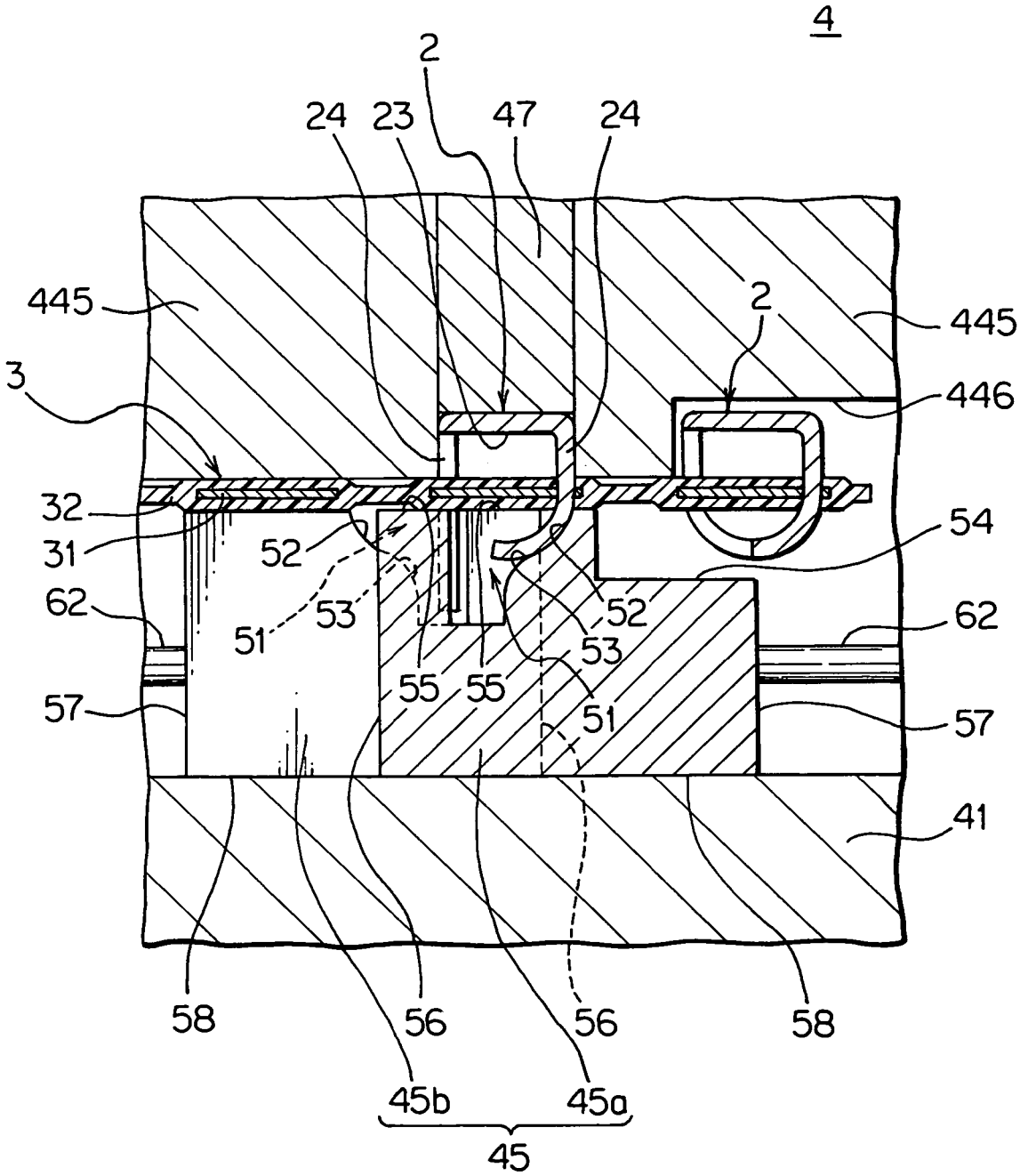
FIG. 7 is a cross-sectional view of the terminal penetrating in the flat circuit body shown in FIG. 5.
Figure 8:
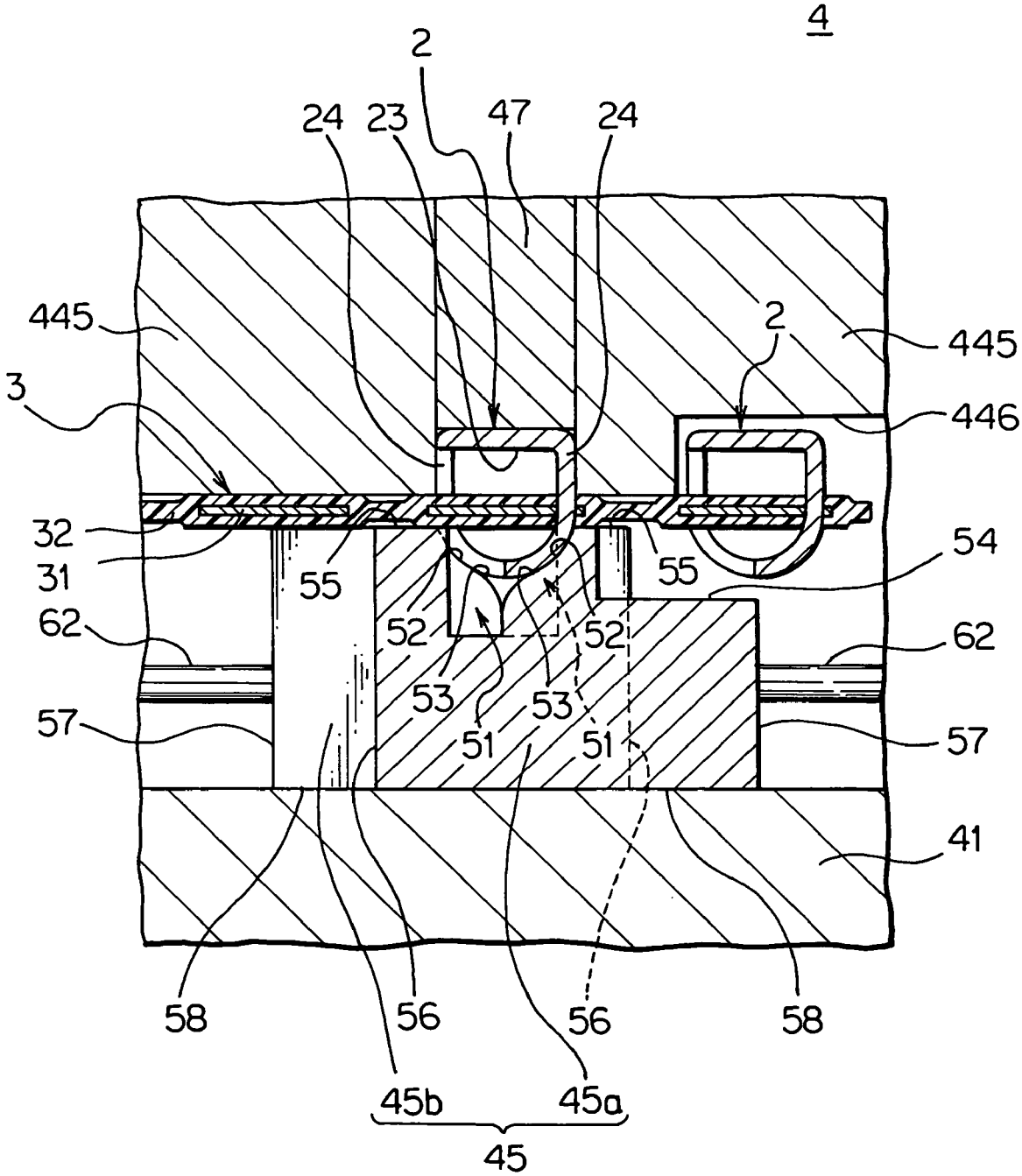
FIG. 8 is another cross-sectional view of the terminal penetrating in the flat circuit body shown in FIG. 5.
Figure 9:
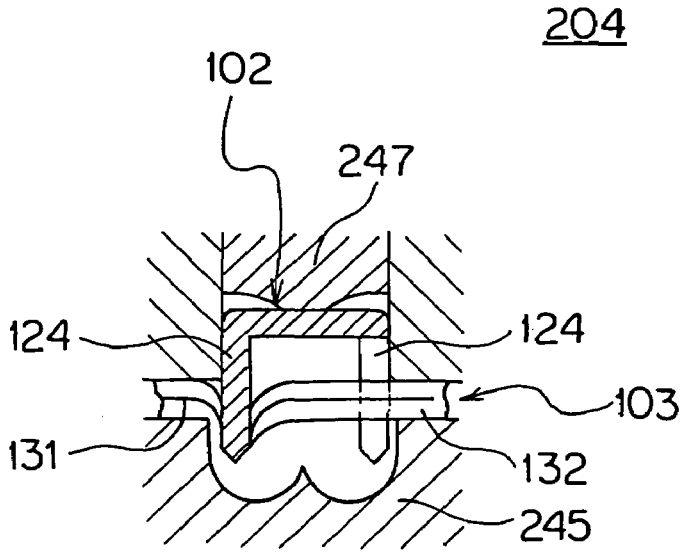
PRIOR ART FIG. 9
FIG. 9 is a cross-sectional view for explaining a method of manufacturing a flat circuit body with terminals by prior art.
Figure 10:
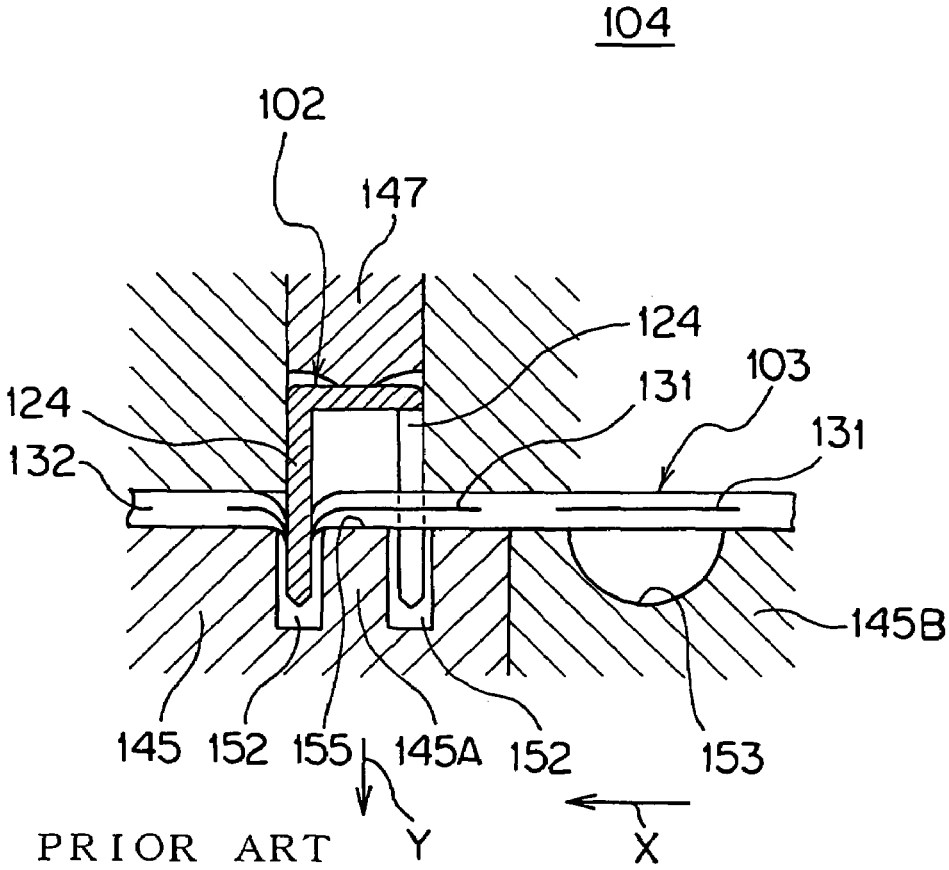
PRIOR ART FIG. 10
FIG. 10 is a cross-sectional view for explaining another method of manufacturing a flat circuit body with terminals by prior art.

By extending the cylinders 60, 60 as shown in FIGS. 7, 8, the pair of dies 45*a*, 45*b* is slid to be close to each other (in the direction of arrows L1, L2 shown in FIG. 6) in the direction intersecting to the direction of the claw 24 piercing in FFC 3. Thereby, the claws 24 penetrating in the recesses 51 abut along the front end to a foot thereof serially on the second curved surface 53 and the first curved surface 52 formed on the inner surface 51A of the recess 51 so as to be bent smoothly along curves of the second curved surface 53 and the first curved surface 52.

Thus, the claws 24 of the piercing terminal 2 pierce in an end part of the FFC 3 and are bent inwardly to each other to clamp the FFC 3, so that the FFC 3 and the piercing terminal 2 are connected electrically and mechanically. The FFC 3, in which the piercing terminal 2 is mounted, is shifted in a direction from die 45*b* to die 45*a*, that is in the direction of widthwise of the FFC 3. The piercing terminal 2 previously mounted on the FFC3 is received in the relief spaces 446, 54. Thereafter, next piercing terminal 2 is mounted on a nest conductive area of the FFC 3 in which piercing terminal 2 is not mounted. The flat circuit body with terminals 1 shown in FIG. 1 is manufactured as above steps. The claws 24, which are bent as mentioned above, have hitting marks by the curved surfaces 52, 53 at surfaces of the claws 24 abutting on the curved surfaces 52, 53.

According to the pair of dies 45*a*, 45*b* shown in FIGS. 7, 8, each one of the pair slides respectively. The pair of dies 45*a*, 45*b* can slide simultaneously.

According to the method of manufacturing the flat circuit body with terminals 1 and the terminal pressure welding apparatus 4 as embodiments of the present invention, when the claws 24 pierce in the conductive area 31 of the FFC 3, the FFC 3 is supported by the abutting surfaces 55 of the support blocks 451A, 452A, 453A, 454A, 455A positioned between recesses 51 of each die 45*a*, 45*b*, so that the FFC 3 can be prevented from deformation. Thereby, the claws 24 can pierce securely into the conductive area 31 of the FFC 3, and reliability of connecting the claws 24 and the conductive area 31 can be improved. According to the method of manufacturing, the claws 24 can securely pierce in the conductive area 31 of the FFC 3, so that no defective product is manufactured and yield of manufacturing can be improved.

The claws 24 penetrating in the recess 51 can be fixed in the same condition by sliding respectively the pair of the dies 45*a*, 45*b* to be close to each other (in the direction of arrows L1, L2 shown in FIG. 6) in the direction intersecting to the direction of the claw 24 piercing in the FFC 3. Thereby, processes of piercing and bending of the claws 24 can be acted continuously. Therefore, the flat circuit body with terminals 1 can be manufactured by small number of steps of working process.

The first curved surface 52 and the second curved surface 53 are formed on the inner surface 51A of the recesses 51 of the pair of dies 45*a*, 45*b*, so that the claw 24 can be bent smoothly from the front end to the foot of the claw 24 without concentration of load at a part of the claw 24. Thereby, the claws 24 can be prevented from damage such as wearing of the front end of the claw 24. In such die system 45, wearing of the dies 45*a*, 45*b* can be reduced and useful life of the dies 45*a*, 45*b* can be extended. Therefore, a cost for exchanging the dies 45*a*, 45*b* can be reduced.

In the flat circuit body with terminals 1 manufactured by the method of manufacturing and the terminal pressure welding apparatus 4 according to the embodiment of the present invention, the claws 24 can pierce securely in the conductive area 31 of the FFC 3, so that the reliability of its connection is high. The claw 24 can be bent without concentration of load at the part of the claw 24, so that durability of its connection is high. The flat circuit body with terminals 1 is manufactured by the high efficiency method of manufacturing with small process steps and the simple structured terminal pressure welding apparatus 4 with one kind of the die system, so that the flat circuit body with terminals 1 can be provided at a low cost.

According to the above embodiment, the flat circuit body with terminals 1 includes the FFC 3 as the flat circuit body. Instead of the FFC, the flat circuit body with terminals of the present invention can include a FPC.

When the flat circuit body with terminals 1, in which the piercing terminal 2 is mounted on only one position of the FFC 3, the above terminal pressure welding apparatus 4 is not required to have relief spaces 446, 54 at the movement 445 and the die system 45.

Although the present invention has been fully described by way of examples with reference to the accompanying drawings, it is to be noted that various change and modifications can be made with the scope of the present invention.

What is claimed is:

1. A method of manufacturing a flat circuit body with terminals, which includes the flat circuit body having a flat conductive area and a conductive metal terminal having a claw to pierce in the flat conductive area of the flat circuit body and to be bent, comprising the steps of:

making said claw pierce in the conductive area of the flat circuit body;

placing the claw piercing in the conductive area into a recess of a die, which can move freely along a direction intersecting to a direction of making the claw pierce in the conductive area; and sliding said die in the direction intersecting to the direction of making the claw pierce in the conductive area for bending said claw.

2. A die system for manufacturing a flat circuit body with terminals, which includes the flat circuit body having a flat conductive area and conductive metal terminals having a claw to pierce in the flat conductive area of the flat circuit body and to be bent, comprising a pair of dies having respectively a recess denting from a surface, on which said flat circuit body is piled, for receiving said claw piercing in the flat conductive area of the flat circuit body within the recess, wherein said pair of dies can move freely along a direction intersecting to a direction of making the claw pierce in the conductive area.

3. The die system for manufacturing a flat circuit body with terminals according to claim 2, wherein the pair of dies include support blocks having the surface, said support blocks being positioned between respective recesses when the claws piercing in the conductive area of the flat circuit body penetrate into the recesses.

4. The die system for manufacturing a flat circuit body with terminals according to claim 3, wherein a first curved surface is provided on an inner surface of said recess so as to be continuous to said surface and be concave from said inner surface, on which the claw abuts when the claw is bent.

5. The die system for manufacturing a flat circuit body with terminals according to claim 4, wherein a second curved surface is provided on the inner surface of said recess so as to be continuous to said first curved surface and be convex from said inner surface of the recess.

6. A manufacturing apparatus for a flat circuit body with terminals, which includes the flat circuit body having a flat conductive area and conductive metal terminals having a claw to pierce in the flat conductive area of the flat circuit body and to be bent, comprising:

the die system claimed in claim 2;

a press unit moving freely close to and apart from said die system for pressing the claw to pierce in the conductive area and making said claw piercing in the conductive area penetrate into the recess by moving close to the die system; and a slide unit for bending the claw penetrating in the recess by sliding the die in the direction intersecting to the direction of making the claw pierce in the conductive area.

7. A flat circuit body with terminals comprising:

a flat circuit body having a flat conductive area; and a conductive metal terminal having a claw to pierce in the flat conductive area of the flat circuit body and to be bent, wherein the claw piercing in the conductive area of the flat circuit body, which penetrates into a recess of a die freely movable in a direction intersecting to a direction of making the claw pierce in the conductive area, is bent by sliding the die in the direction intersecting to the direction of making the claw pierce in the conductive area.

8. A manufacturing apparatus for a flat circuit body with terminals, which includes the flat circuit body having a flat conductive area and conductive metal terminals having a claw to pierce in the flat conductive area of the flat circuit body and to be bent, comprising:

the die system claimed in claim 3;

a press unit moving freely close to and apart from said die system for pressing the claw to pierce in the conductive area and making said claw piercing in the conductive area penetrate into the recess by moving close to the die system; and a slide unit for bending the claw penetrating in the recess by sliding the die in the direction intersecting to the direction of making the claw pierce in the conductive area.

9. A manufacturing apparatus for a flat circuit body with terminals, which includes the flat circuit body having a flat conductive area and conductive metal terminals having a claw to pierce in the flat conductive area of the flat circuit body and to be bent, comprising:

the die system claimed in claim 4;

a press unit moving freely close to and apart from said die system for pressing the claw to pierce in the conductive area and making said claw piercing in the conductive area penetrate into the recess by moving close to the die system; and a slide unit for bending the claw penetrating in the recess by sliding the die in the direction intersecting to the direction of making the claw pierce in the conductive area.

10. A manufacturing apparatus for a flat circuit body with terminals, which includes the flat circuit body having a flat conductive area and conductive metal terminals having a claw to pierce in the flat conductive area of the flat circuit body and to be bent, comprising:

the die system claimed in claim 5;

a press unit moving freely close to and apart from said die system for pressing the claw to pierce in the conductive area and making said claw piercing in the conductive area penetrate into the recess by moving close to the die system; and a slide unit for bending the claw penetrating in the recess by sliding the die in the direction intersecting to the direction of making the claw pierce in the conductive area.

* * * * *